US006299566B1

(12) United States Patent
Wu

(10) Patent No.: US 6,299,566 B1
(45) Date of Patent: Oct. 9, 2001

(54) DRIVING DEVICE OF A LEG EXERCISE MACHINE

(76) Inventor: Dong-Her Wu, No. 141, Sec. 2, Chang-Shui Road, Chang Hua Hsien (TW)

( * ) Notice: Subject to any disclaimer, the term of this patent is extended or adjusted under 35 U.S.C. 154(b) by 0 days.

(21) Appl. No.: 09/638,736

(22) Filed: Aug. 15, 2000

(51) Int. Cl.[7] ..... A63B 22/04
(52) U.S. Cl. ..... 482/52; 482/57
(58) Field of Search ..... 482/51, 57–65, 482/70, 79, 80, 52; 601/36, 27, 29, 31, 32, 23

(56) References Cited

U.S. PATENT DOCUMENTS 3,712,613 * 1/1973 Feather et al. ..... 482/57
4,637,379 * 1/1987 Saringer ..... 601/34
4,676,501 * 6/1987 Hoagland et al. ..... 482/51
4,842,265 * 6/1989 Kirk ..... 128/25 B
5,314,390 * 5/1994 Westing et al. ..... 601/36
5,456,648 * 10/1995 Edinburg et al. ..... 482/4
5,514,053 * 5/1996 Hawkins et al. ..... 601/36
6,001,071 * 12/1999 Butler ..... 601/36

* cited by examiner

*Primary Examiner*—Stephen R. Crow
(74) *Attorney, Agent, or Firm*—Harrison & Egbert

(57) ABSTRACT

A driving device is mounted in the frame of a leg exercise machine and is formed of a motor having a spindle on which a transmission gear is mounted to impart the motion to a sprocket wheel via a chain. Two locating seats are movably disposed on the chain which is actuated to move along two guide slots of the seat of the leg exercise machine. Each of the locating seats are provided with a leg rod capable of a reciprocating motion along with the locating seat. The guide slots are provided with a switch to control the rotational direction of the motor.

3 Claims, 6 Drawing Sheets

DRIVING DEVICE OF A LEG EXERCISE MACHINE

BACKGROUND OF THE INVENTION

1. Field of the Invention

The present invention relates generally to a leg exercise machine, and more particularly to a driving device of the leg exercise machine.

2. Description of Related Art

The conventional leg exercise machines are not provided with a driving device to facilitate the using of the leg exercise machines by the physically weak persons.

BRIEF SUMMARY OF THE INVENTION

The primary objective of the present invention is to provide a leg exercise machine with a driving device which is mounted in the front end of a frame of the leg exercise machine and is formed of a motor, a gear, a sprocket wheel, two locating seats, two pedals, and two switches. The gear is mounted on a spindle of the motor and is linked with the sprocket wheel by a chain on which the two locating seats are movably disposed. As one of the switches is touched by the pedals, the rotational direction of the motor is caused to change so as to bring about the reciprocating motion of the pedals.

The features, functions, and advantages of the present invention will be more readily understood upon a thoughtful deliberation of the following detailed description of the present invention with reference to the accompanying drawings.

DETAILED DESCRIPTION OF THE INVENTION

Figure 1:
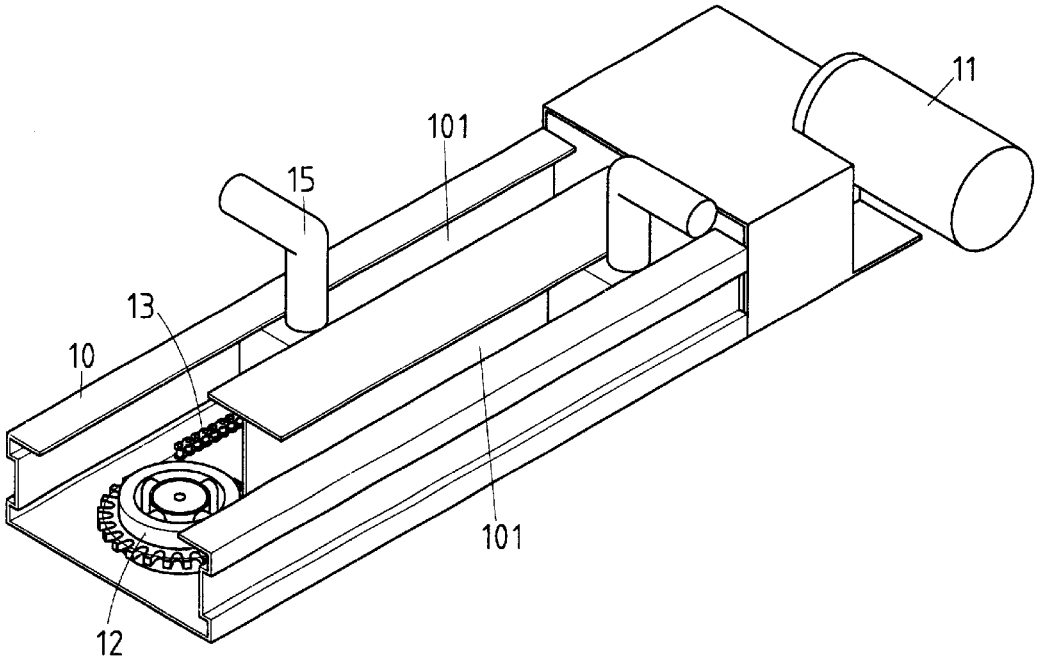
FIG. 1 shows a perspective view of the present invention.
Figure 2:
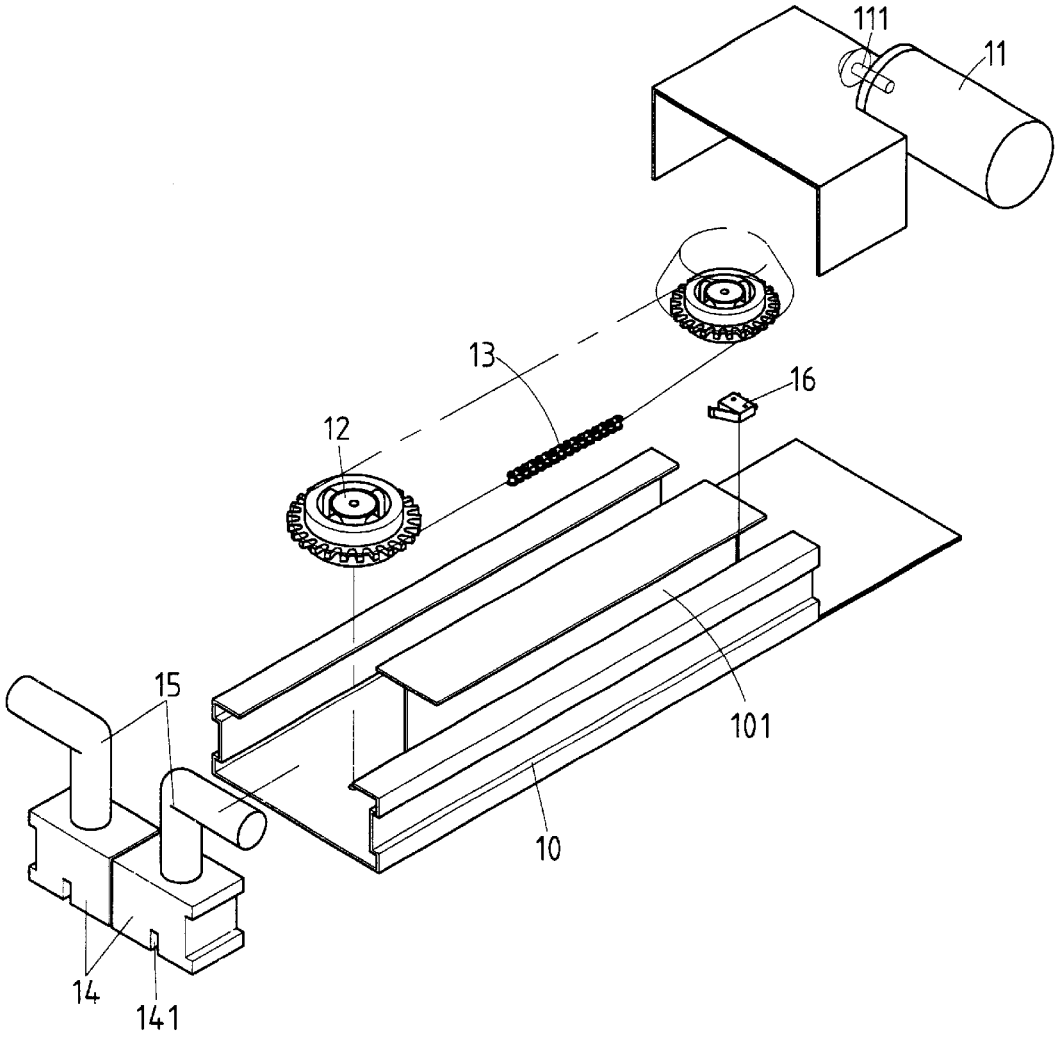
FIG. 2 shows an exploded view of the present invention.
Figure 3:
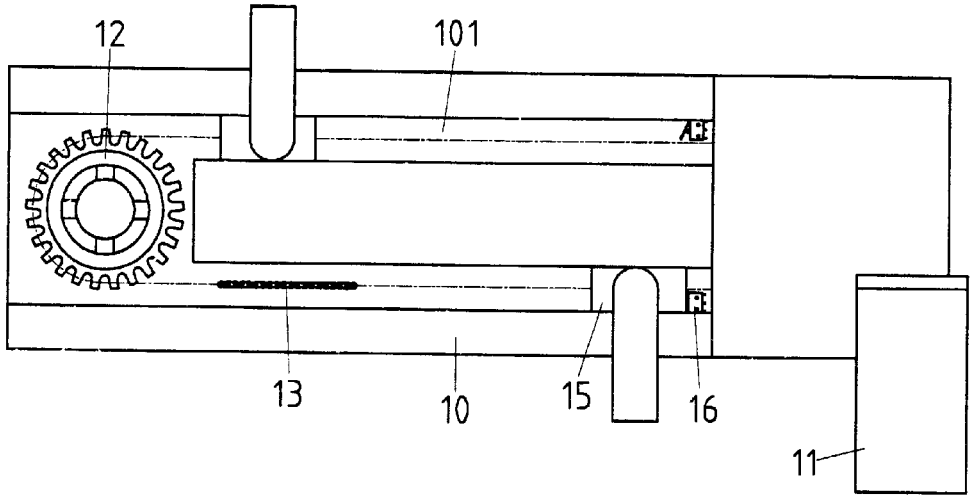
FIG. 3 shows a schematic plan view of the present invention in action.
Figure 4:
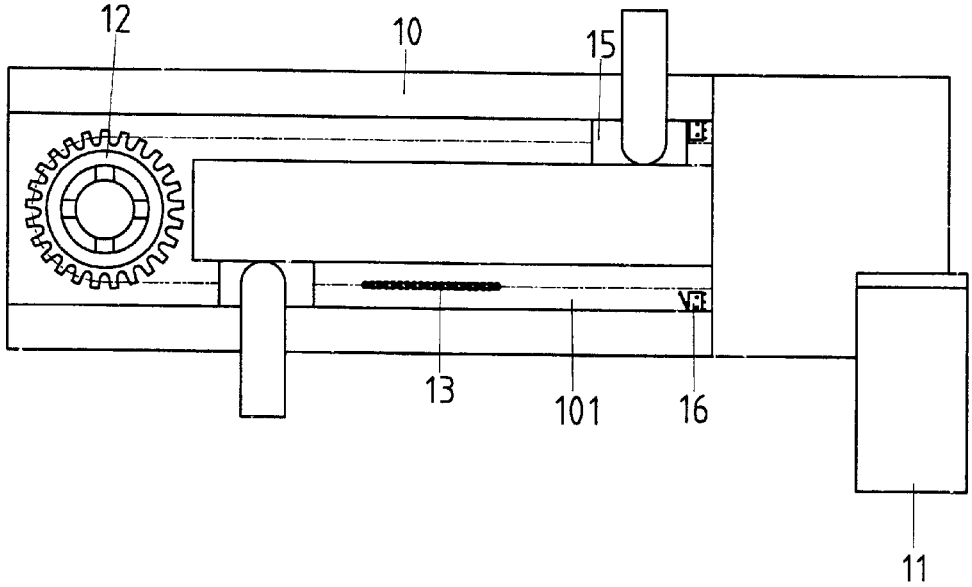
FIG. 4 shows another schematic plan view of the present invention in action.
Figure 5:
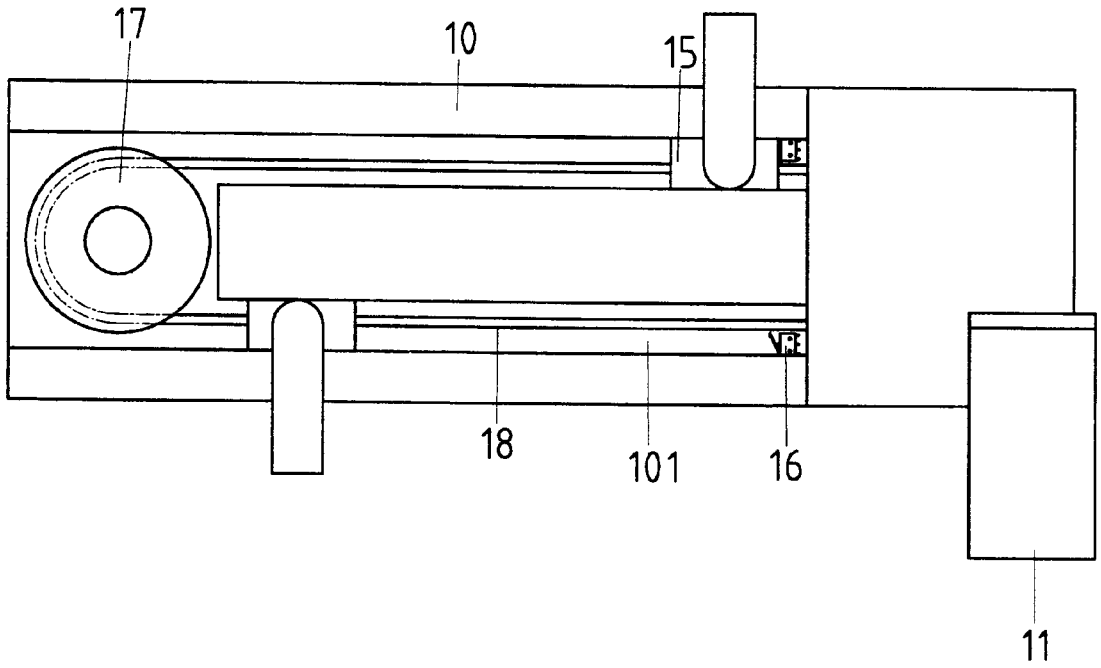
FIG. 5 shows a schematic view of the transmission mechanism of the present invention.
Figure 6:
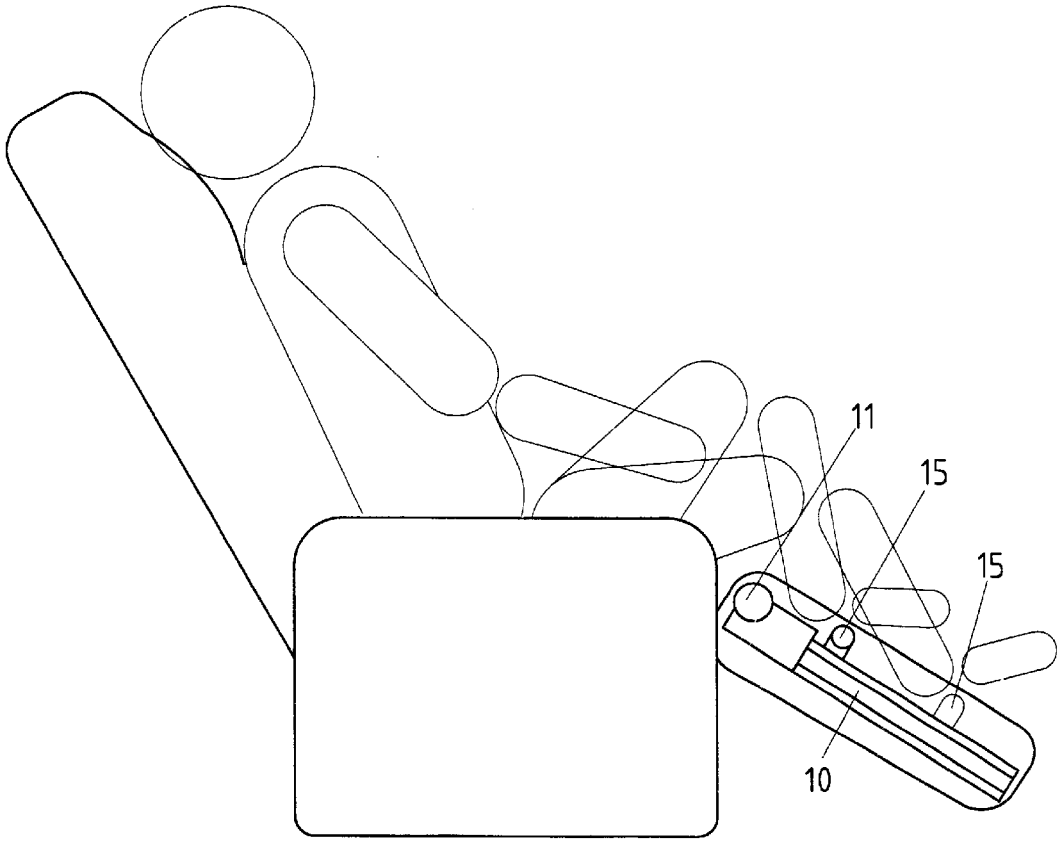
FIG. 6 shows a schematic view of the present invention at work.
Figure 7:
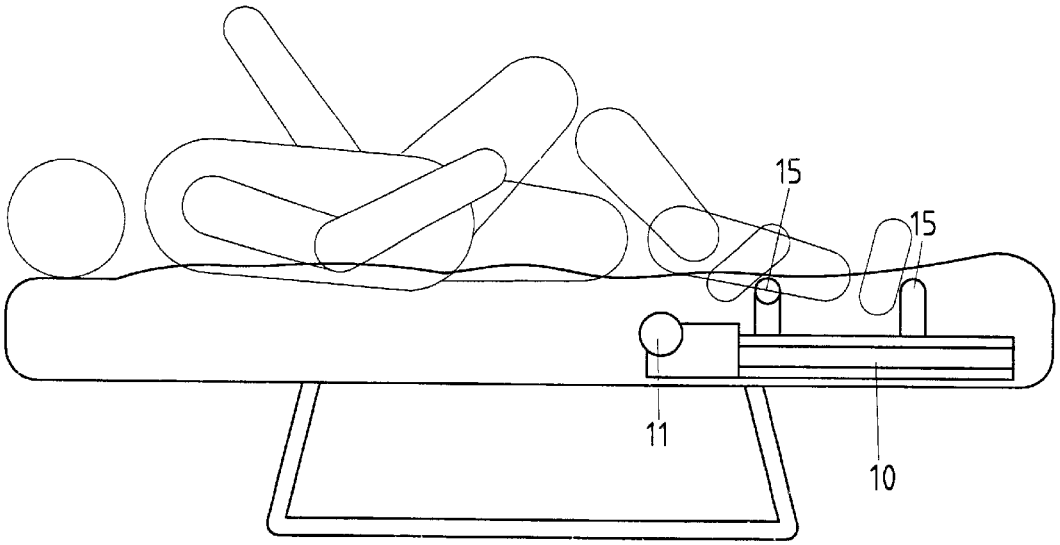
FIG. 7 shows another schematic view of the present invention at work.

As shown in FIGS. 1–7, a driving device of the present invention is mounted in two guide slots 101 of the frame 10 of a leg exercise machine and is formed of a motor 11, one or more transmission gears, a sprocket wheel 12, two locating seats 14, two pedals 15, and two switches 16.

The motor 11 has a spindle 111 on which the transmission gear is mounted such that the transmission gear is linked with the sprocket wheel 12 by a chain 13. The two locating seats 14 are movably disposed on the chain 13. The two pedals 15 are respectively fastened to the locating seats 14 so as to move back and forth along with the locating seats 14. The two switches 16 are respectively disposed in the two guide slots 101 of the frame 10 of the leg exercise machine. The transmission gear may be linked with the sprocket wheel 12 by a transmission belt or cable in place of the chain 13.

In operation, the soles of the feet of a user of the leg exercise machine are rested on the two pedals 15 before the motor 11 is started. As the motor 11 is started, motion is imparted to the sprocket wheel 12 via the transmission gear and the chain 13, thereby resulting in the displacing of the two pedals 15. As the locating seats 14 are moved along with the chain 13, the locating seats 14 will come in contact with one of the two switches 16, thereby resulting in a change in the rotational direction of the motor 11. As a result, the locating seats 14 are driven to move in a direction toward another one of the two switches 16. The reciprocating motion of the pedals 15 is thus effected to exercise the legs of a user of the leg exercise machine.

The present invention described above is to be regarded in all respects as being merely illustrative, not restrictive. Accordingly, the present invention may be embodied in other specific forms without deviating from the spirit thereof. The present invention is therefore to be limited only by the scopes of the following appended claims.

I claim:

1. A leg exercise machine comprising:

a frame having two guide slots; and a driving device mounted in said two guide slots, said driving device comprising:

a motor having a spindle;

a transmission gear mounted on said spindle;

a sprocket wheel;

a chain linking said transmission gear to said sprocket wheel;

two locating seats movably disposed on said chain, each of said two locating seats having a pedal fastened thereto; and two switches disposed respectively in said two guide slots of said frame and connected to said motor whereby a rotational direction of said motor is changed when said locating seats come into contact with said switches.

2. The machine of claim 1, said chain being a transmission belt.

3. The machine of claim 1, said chain being a cable.

* * * * *